United States Patent [19]

Onoue

[11] Patent Number: 4,923,417

[45] Date of Patent: May 8, 1990

[54] PROPELLER HOUSING RETAINER FOR MARINE PROPULSION DEVICE

[75] Inventor: Akihiro Onoue, Hamamatsu, Japan

[73] Assignee: Sanshin Kogyo Kabushiki Kaisha, Hamamatsu, Japan

[21] Appl. No.: 357,645

[22] Filed: May 25, 1989

Related U.S. Application Data

[63] Continuation of Ser. No. 145,965, Jan. 20, 1988, abandoned.

[30] Foreign Application Priority Data

Jan. 23, 1987 [JP] Japan ..... 62-13867

[51] Int. Cl.[5] ..... B63H 1/14; B63H 1/28

[52] U.S. Cl. ..... 440/78; 440/900

[58] Field of Search ..... 440/75, 78, 900, 83; 384/562

[56] References Cited

U.S. PATENT DOCUMENTS

| | | | |
|---|---|---|---|
| 3,937,093 | 2/1976 | Johnson et al. | 440/78 |
| 3,952,687 | 4/1976 | Brownlie et al. | 440/75 |
| 3,968,767 | 7/1976 | Blanchard | 440/75 |
| 4,317,655 | 3/1982 | Schiek | 440/78 |
| 4,413,865 | 11/1983 | Hackbarth | 308/207 R |

*Primary Examiner*—Joseph F. Peters, Jr.
*Assistant Examiner*—Edwin L. Swinehart
*Attorney, Agent, or Firm*—Ernest A. Beutler

[57] ABSTRACT

A number of embodiments of arrangements for securing an journaling a propeller shaft in the lower unit of a marine outboard drive. In each embodiment, a bearing carrier supports the propeller shaft, and the bearing carrier is locked in place by means including an inclined wedging member that provided both an axial force on the bearing carrier and a radial locating force.

7 Claims, 3 Drawing Sheets

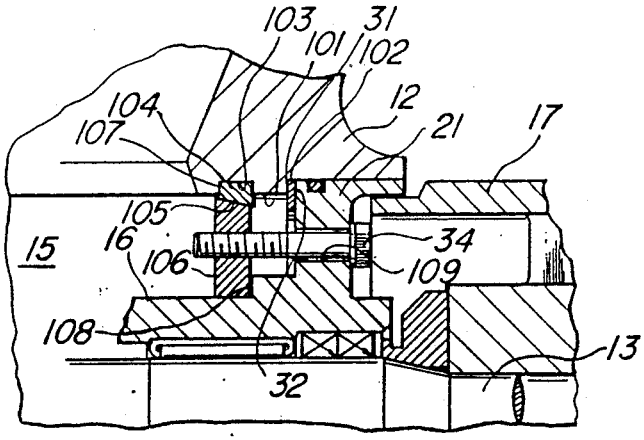
Fig-4
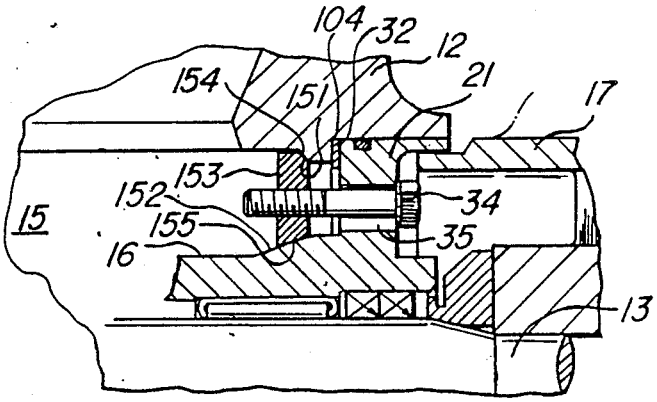
Fig-5
Fig-6
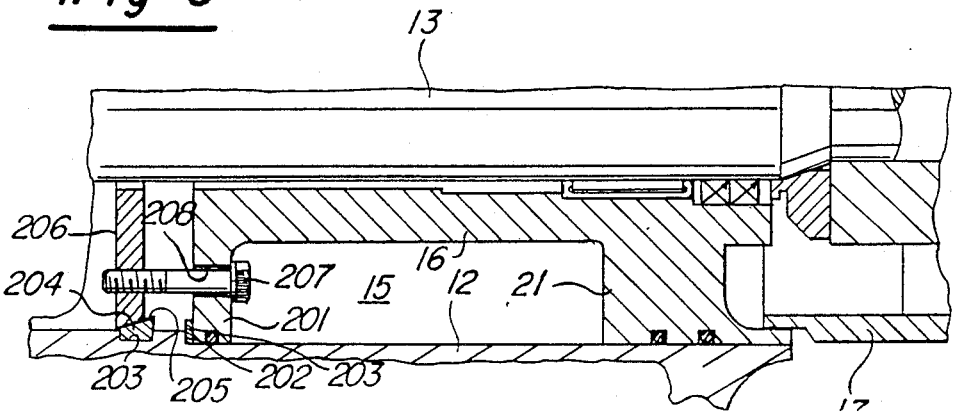

PROPELLER HOUSING RETAINER FOR MARINE PROPULSION DEVICE

This is a continuation of U.S. patent application Ser. No. 145,965, filed Jan. 20, 1988 now abandoned.

BACKGROUND OF THE INVENTION

This invention relates to a propeller housing retainer for a marine propulsion device and more particularly to an improved arrangement for supporting a propeller shaft within the lower unit of a marine propulsion device.

In one common form of marine propulsion device there is incorporated a lower unit in which the propeller shaft and drive for the propeller shaft are contained. Normally, the propeller shaft is driven by a bevel gear train from a drive shaft which is, itself, also journaled within the lower unit. With this type of arrangement, it is a normal practice to employ a bearing carrier that is inserted into a rearwardly extending opening of the lower unit and which journals the propeller shaft. In accordance with such an arrangement, the bearing carrier is normally provided with a shoulder that faces and abuttingly engages a shoulder of the lower unit so as to hold the bearing carrier in place. Various arrangements have been proposed for holding the bearing carrier shoulder in abutment with the lower unit shoulder so as to axially position the bearing carrier within the lower unit. Although a number of arrangements have been proposed for this purpose, they all present a disadvantage in that they either cannot be easily assembled and disassembled or, alternatively, they do not ensure tight holding of the bearing carrier in place and, in some instances, may permit the bearing carrier to become misaligned in a direction radially of the propeller shaft.

It is, therefore, a principal object of this invention to provide an improved propeller housing retainer for a marine propulsion device.

It is a further object of this invention to provide an improved propeller shaft bearing carrier and mounting arrangement therefor for the lower unit of a marine propulsion device.

It is a further object of this invention to provide a improved construction for retaining a bearing carrier in a lower unit and which will prevent movement in all directions.

SUMMARY OF THE INVENTION

This invention is adapted to be embodied in an arrangement for mounting a propeller shaft in the lower unit of an outboard drive. The lower unit has an outer housing the defines a cavity in part by means of a circumferentially extending generally radially facing shoulder. A bearing carrier is adapted to be received, at least in part in the lower unit casing, and rotatably journals the propeller shaft. The bearing carrier has a shoulder that faces the lower unit housing shoulder, and fastening means urge the bearing carrier shoulder toward the lower unit shoulder. In accordance with the invention, the fastening means has an inclined wedging surface that is inclined at an angle to the shoulder and a cooperating inclined wedging surface is formed on one of the bearing carriers and outer housing and is engageable with the fastening means wedging surface for effecting a radial thrust upon the fastening means. Means are incorporated for urging the fastening means in an axial direction for bringing the wedging surfaces into engagement to effect the radial thrust upon the fastening means and for also urging the shoulders toward each other.

BRIEF DESCRIPTION OF THE DRAWINGS

FIG. 4 is a partial cross-sectional view, in part similar to FIG. 2, showing a second embodiment of the invention.

FIG. 5 is a partial cross-sectional view, in part similar to FIGS. 2 and 4, showing a third embodiment of the invention.

FIG. 6 is a partial cross-sectional view, in part similar to FIGS. 2, 4 and 5, and shows a fourth embodiment of the invention.

DETAILED DESCRIPTION OF THE PREFERRED EMBODIMENTS OF THE INVENTION

Figure 1:
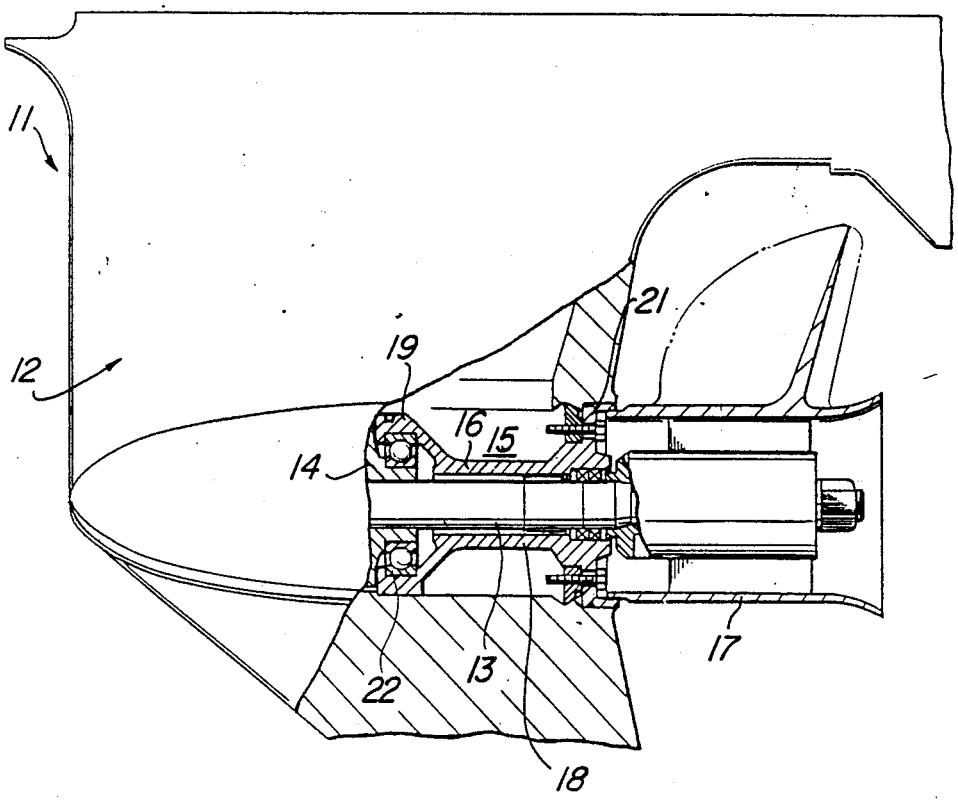
FIG. 1 is a side elevational view, with a portion broken away, of a lower unit of a marine propulsion device constructed in accordance with a first embodiment of the invention.

Referring first to FIG. 1, a lower unit of a marine propulsion device is identified generally by the reference numeral 11 and is depicted as a typical environment in which the invention may be practiced. The lower unit 11 may form the lower unit of an outboard drive portion of an inboard outboard drive arrangement or may form the lower unit of an outboard motor per se. The term "outboard drive" is used generically to cover either type of embodiment. The lower unit 11 is comprised of an outer housing, indicated generally by the reference numeral 12 and which may be formed as a casting from aluminum or another similar material. A drive shaft (not shown) is supported for rotation within the outer housing 12 is a known manner for rotation about a generally vertically extending axis and drives a propeller shaft 13 by means of a suitable transmission mechanism including a bevel gear, which is shown only partially and is identified by the reference numeral 14. The bevel gear 14 may form one of the gears of a typical forward-neutral reverse transmission that is well known in this art and is coupled to the propeller shaft 13 by means of a dog-clutching assembly (not shown). The lower unit casing 12 is formed with a generally cylindrically shaped opening 15 which opens through a rear face of the lower unit casing. A bearing carrier 16 is supported within this cavity 15, in a manner to be described, and supports at least in part the propeller shaft 13 for rotation about a generally horizontally disposed axis. A propeller 17 is affixed in any known manner to the end of the propeller shaft 13 that protrudes outwardly from the lower unit cavity 15 and rearwardly of the bearing carrier 16.

Figure 3:
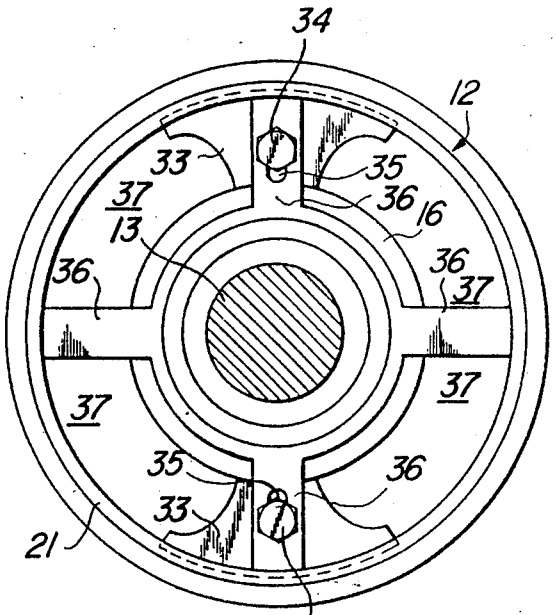
FIG. 3 is a cross-sectional view taken along the line 3—3 of FIG. 2.
Figure 2:
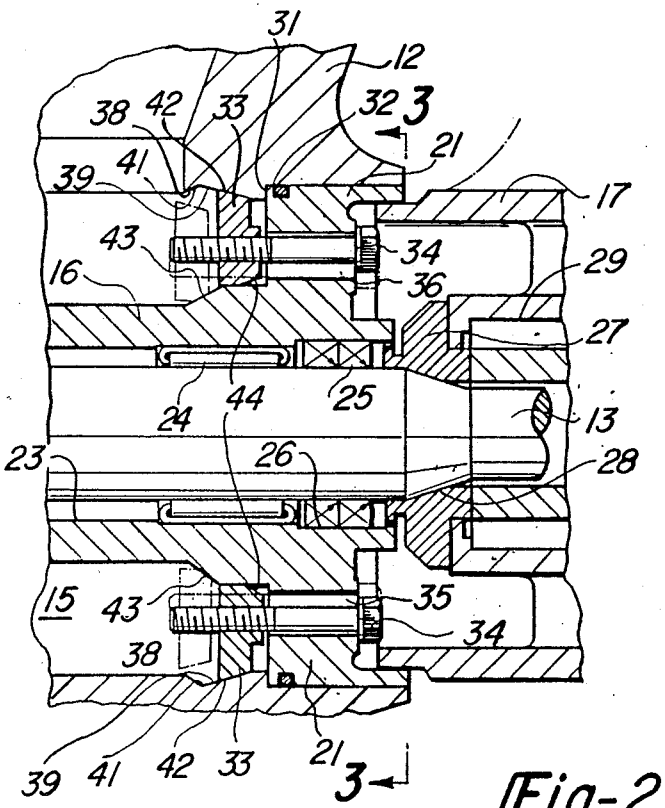
FIG. 2 is an enlarged view of a portion of the area shown in cross-section in FIG. 1.

Referring now additionally to FIGS. 2 and 3, the bearing carrier 16 has a generally spool shape comprised of a cylindrical center section 18 with a pair of larger diameter sections 19 and 21 formed at its opposite ends. The section 19 is formed with a counterbore that receives a ball bearing assembly 22 that journals the hub of the bevel gear 14 and, accordingly, the adjacent portion of the propeller shaft 13. The central section 18 is formed with a through bore 23 that receives a needle type bearing 24 adjacent the enlarged diameter portion 21 for rotatably journaling the rear end of the propeller shaft 13. A seal assembly 25 is contained within a counterbore 25 formed at the rear end of the bearing carrier 16 for sealingly engaging the propeller shaft 13 and precluding the leakage of water into the bearing assembly.

A thrust collar 27 engages a tapered portion 28 of the propeller shaft 13 and is engaged by a hub 29 of the propeller 17 for transmitting forward driving thrust to the lower unit 11.

The bearing carrier enlarged portion 21 is defined in part by a generally radially extending shoulder 31 that is adapted to abuttingly engaged a corresponding shoulder 32 that extends circumferentially around the lower unit cavity 15. A fastening arrangement, illustrated best in FIGS. 2 and 3, is provided for axially urging the bearing carrier 16 into the cavity 15 and the shoulders 31 and 32 into abutting engagement. This fastening means is comprised of a pair of fastening wedging elements 33 that have a generally arcuate shape and which are urged into engagement with respective wedging surfaces to be described, formed on the bearing carrier 16 and lower unit outer housing 12 by means of threaded fasteners 34 so as to achieve this fastening arrangement. The wedging fastening means have tapped openings which receive the threads of the threaded fasteners 34. The threaded fasteners 34 pass through generally radially extending slots 35 formed in radially extending ribs 36 of the bearing carrier 16. The ribs 36 define circumferentially spaced openings 37 which are employed for a through the hub exhaust system, of a known type, for exhausting the exhaust gases from the powering internal combustion engine.

Rearwardly of the shoulder 32, the lower unit outer housing 12 is provided with a generally V-shaped recess consisting of a first inclined portion 38 and an opposite second inclined portion 39 which inclined portions meet at a bight 41. The wedging fastening members 33 are provided with inclined wedging surfaces 42 that are complementary to and adapted to engage the wedging surfaces 39. In addition, the bearing carrier 16 is provided with an inclined wedging surface 43 which is adapted to cooperate with an inclined wedging surface 44 formed on the inner periphery of the wedging fastening member 33.

This embodiment is assembled in the following manner. First, the threaded fasteners 34 are loosened so that the wedging fastening members 33 will be in the position shown in the phantom line view in FIG. 2. As such, the outer periphery edges of the wedging surfaces 42 will be spaced inwardly to clear the cavity 15 of the lower unit inwardly of the shoulder 32. The bearing carrier 16 may then be inserted into place. At this time, the shoulders 31 and 32 will be slightly spaced axially from each other. The fasteners 34 are then tightened drawing the wedging members 33 rearwardly. The cooperation of the wedging surfaces 43 and 44 will cause the wedging members 33 to move outwardly, such movement being permitted by the radial extent of the slots 35. Eventually, the wedging surfaces 42 of the wedging members 33 will engage the cooperating wedging surfaces 41 of the lower unit housing 12 and cause the bearing member 16 to be drawn inwardly so that the shoulder 31 will engage the shoulder 32. At the same time, the wedging members 33 will be wedged inwardly so that the their cylindrical inner surfaces will engage a cylindrical surface formed on the bearing carrier 16 so as to radially position it. Therefore, both axial and radial positioning is achieved through a single fastening means. The method of disassembly is believed to be obvious from the foregoing description.

FIG. 4 shows another embodiment of the invention which is generally similar to the embodiment thus far described. For that reason, the components which have the same construction as the components of the previously described embodiment have been identified by the same reference numerals and will not be described again, except insofar as is necessary to understand the construction and operation of this embodiment. In this embodiment, the cavity 15 is defined by a cylindrical surface 101 that terminates adjacent the shoulder 32. If desired, a shim 102 may be provided between the shoulder 32 and 31 so as to adjust the axial positioning of the bearing carrier 16.

In this embodiment, the cylindrical surface 101 is formed with a cylindrical groove 103 in which a pair of arcuate members 104 are received. The arcuate members 104 have rearwardly facing inclined surfaces 105.

A pair of arcuate wedging or locking members 106 are provided that have inclined surfaces 107 that are complimentary to the inclined surfaces 106. The wedging members 106 are adapted to cooperate with a shoulder 108 formed on the bearing carrier 16 and are urged into this engagement by means of the fastener 34 which passes through an aperture 109 formed in the bearing carrier 16, as with the previously described embodiments.

This embodiment is assembled as follows. The locking or wedging members 107 are loosely retained relative to the bearing carrier 16 by the threaded fasteners 34 before insertion. The bearing carrier 16 is then rotated slightly so as to clear the arcuate members 104 and to permit the entire assembly to be inserted into place. The bearing carrier 16 is then rotated back to its original position so that the wedging members 106 will be aligned with the arcuate members 104 and the fastening means 34 are progressively tightened. As this occurs, the cooperation of the inclined wedging surfaces 105 and 106 will act to center the bearing carrier 16 and also effect its movement axially into the lower unit bore 101 until the surface 31 engages the shim 102 and provides the accurate axial location desired.

FIG. 5 shows yet another embodiment of the invention. As with the previously described embodiments, those components which are substantially the same in construction have been identified by the same reference numeral and will be described again in detail only insofar as is necessary to understand the construction and operation of this embodiment.

In this embodiment, the lower unit housing 12 has an inclined surface 151 that is formed adjacent the outer periphery of the cavity 15. The shoulder 32 is disposed outwardly of this inclined surface. In this embodiment, the bearing carrier 16 is also provided with an inclined surface 152 that is formed adjacently to its enlarged portion 21. A pair of wedging members 153 are provided with respective inclined surfaces 154 and 155 that cooperate with the wedging surfaces 151 and 152 respectively so as to provide the axial movement of the bearing carrier 16 and also so as to radially locate it. As with the previously described embodiments, a threaded fastener 34 extends through an enlarged slot 35 in the bearing carrier portion 21 so as to permit radial movement.

Like the previously described embodiments, the wedging members 153 are affixed to the bearing carrier 16 by the threaded fasteners 34 before installation. However, the wedging members 153 are loosely in place so that they can be inserted beyond or past the shoulder 151. The fastening members 34 are then tightened to bring the wedging member surfaces 154 and 155 into engagement with the lower unit surface 151 and the bearing carrier surface 152 to provide radial location and to axially draw the bearing carrier 16 toward the shoulder 32 for fixing its axial location. As with the embodiment of FIG. 4, a shim 102 may be positioned between the bearing carrier portion 21 and the shoulders 32 for adjustment of the axial position.

FIG. 6 shows another embodiment of the invention. This embodiment uses a locating system for the bearing carrier that is disposed inwardly from the outer end of the lower unit bore 15. However, the principle for attachment is generally similar and components of this embodiment which are the same or generally the same as those of the previously described embodiments have been identified by the same reference numeral and will be described again in detail only insofar as is necessary to understand the construction and operation of this embodiment.

In this embodiment, the bearing carrier 16 is provided with an inner cylindrical portion 201 that is juxtaposed to a shoulder 202 formed in the lower unit casing 12 at one end of the cavity 15. Inwardly of this area, the lower unit is provided with a circumferential recess 32 in which a pair of arcuate wedging members 204 are positioned which have inclined wedging surface 205. A pair of wedging members 206 have inclined surfaces that cooperate with the surfaces 205 so as to provide radial location and also an axial force to bring the bearing carrier portion 201 into engagement with the shoulder 202 or a shim 203 that is interposed between the respective shoulders. A threaded fastener 207 extends through an elongated slot 208 for providing the axial force. The assembly is generally the same as the previously described embodiments in that the wedging members 206 are affixed loosely to the bearing carrier 16 upon installation and then are tightened so as to effect axial movement of the bearing carrier 16 and its radial and axial location.

It should be readily apparent from the foregoing description that a number of embodiments of the invention have been illustrated and described, each of which provides an effective arrangement for securing a propeller shaft in the lower unit of an outboard drive and providing both radial and axial location. Although a number of embodiments of the invention have been illustrated and described, various changes and modifications may be made without departing from the spirit and scope of the invention as defined by the appended claims.

I claim:

1. An arrangement for mounting a propeller shaft for rotation about an axis in the lower unit of an outboard drive, said lower unit having an outer housing defining a cavity defined in part by an outer housing shoulder extending circumferentially around said axis, a bearing carrier received, at least in part, in said cavity and rotatably journaling said propeller shaft about said axis, said bearing carrier having a shoulder facing said lower unit outer housing shoulder, and wedging means for urging said bearing carrier shoulder toward said lower unit shoulder, said wedging means having an inclined wedging surface inclined at an angle to said shoulder, a cooperating inclined wedging surface formed by said outer housing engageable with said wedging means wedging surface for effecting a radial thrust on said wedging means, and threaded fastening means for urging said wedging means in an axial direction for bringing said wedging surfaces into engagement to effect thrust upon said wedging means in a radial direction relative to said axis and for urging said shoulders axially toward each other.

2. An arrangement as set forth in claim 1 wherein the cooperating inclined wedging surface is formed axially inwardly of the outer housing shoulder.

3. An arrangement as set forth in claim 2 wherein the cooperating inclined wedging surface is formed integrally with the outer housing.

4. An arrangement as set forth in claim 2 wherein the cooperating inclined wedging surface is formed by a separate member fixed axially relative to the outer housing.

5. An arrangement as set forth in claim 4 wherein there is a further cooperating inclined wedging surface formed on the bearing carrier generally axially aligned with the cooperating inclined wedging surface of the outer housing.

6. An arrangement as set forth in claim 5 wherein the first mentioned cooperating inclined wedging surface is formed integrally with the outer housing.

7. An arrangement as set forth in claim 5 wherein the first mentioned cooperating inclined wedging surface is formed by a separate member fixed axially relative to the outer housing.

* * * * *

UNITED STATES PATENT AND TRADEMARK OFFICE

CERTIFICATE OF CORRECTION

PATENT NO. : 4,923,417

DATED : May 8, 1990

INVENTOR(S) : Akihiro Onoue

It is certified that error appears in the above-identified patent and that said Letters Patent is hereby corrected as shown below:

On the title page:
Abstract, line 2, "an" should be --and--;
Abstract, line 6, "provided" should be --provides--.
Column 6, line 37, Claim 5, "4" should be --2--.

Signed and Sealed this

Eighth Day of December, 1992

*Attest:*

DOUGLAS B. COMER

*Attesting Officer*

*Acting Commissioner of Patents and Trademarks*